US008196930B2

(12) United States Patent
Bakshi et al.

(10) Patent No.: US 8,196,930 B2
(45) Date of Patent: Jun. 12, 2012

(54) MOOVDISK

(75) Inventors: Anthony Bakshi, Morganville, NJ (US); Moyukh Chatterjee, Manalapan, NJ (US); Jeffrey Hart, Freehold, NJ (US); Lahiru Mudalige, Oakhurst, NJ (US); Matthew Warshauer, West Long Branch, NJ (US); Patricia L. Christen, Piedmont, CA (US)

(73) Assignee: HopeLab Foundation, Inc., Redwood City, CA (US)

( * ) Notice: Subject to any disclaimer, the term of this patent is extended or adjusted under 35 U.S.C. 154(b) by 487 days.

(21) Appl. No.: 12/396,222

(22) Filed: Mar. 2, 2009

(65) Prior Publication Data

US 2009/0221371 A1 Sep. 3, 2009

Related U.S. Application Data

(60) Provisional application No. 61/032,903, filed on Feb. 29, 2008.

(51) Int. Cl.
*A63B 67/00* (2006.01)

(52) U.S. Cl. ..... 273/445; 463/7; 273/440; 273/444; 273/447

(58) Field of Classification Search ..... 463/7; 273/440, 273/444, 445, 447
See application file for complete search history.

(56) References Cited

U.S. PATENT DOCUMENTS

| | | | |
|---|---|---|---|
| 4,072,930 | A | 2/1978 | Lucero et al. |
| 4,307,538 | A | 12/1981 | Moffitt |
| 4,529,193 | A | 7/1985 | Kuhnsman |
| 4,720,789 | A | 1/1988 | Hector et al. |
| 4,776,585 | A | 10/1988 | Maleyko et al. |
| 5,071,118 | A | 12/1991 | Barnett |
| 5,087,034 | A | 2/1992 | Solis |
| 5,139,261 | A | 8/1992 | Openiano |
| 5,243,517 | A | 9/1993 | Schmidt et al. |
| 5,307,263 | A | 4/1994 | Brown |
| 5,389,056 | A | 2/1995 | Ricker |
| 5,533,947 | A | 7/1996 | Tomlinson et al. |
| 5,678,571 | A | 10/1997 | Brown |
| 5,730,654 | A | 3/1998 | Brown |
| 5,842,766 | A | 12/1998 | Scharf, III |
| 5,879,163 | A | 3/1999 | Brown |

(Continued)

FOREIGN PATENT DOCUMENTS

WO WO95/04430 A1 2/1995

(Continued)

OTHER PUBLICATIONS

Hyper Dash (http://www.wildplanet.com/press/wp_release_single.php?prid=102).*

(Continued)

*Primary Examiner* — Nathan W. Ha
*Assistant Examiner* — Yu-Hsi D Sun
(74) *Attorney, Agent, or Firm* — Shay Glenn, LLP

(57) ABSTRACT

Described herein is a game system that includes a game control unit that communicates with a plurality of play units. Each play unit typically has a user input functionality (e.g., a button) and a visual indicator (e.g., lights). The play units can communicate and receive instructions from the game control unit. The game control unit may also include a user input, and can track play and upload results (e.g., scores) into a central data repository. Players may wear identification tags that can also provide identifying information for tracking or monitoring by the game control unit. Also described herein are methods of playing games using the system, and social networking website for players.

12 Claims, 2 Drawing Sheets

U.S. PATENT DOCUMENTS

| | | | |
|---|---|---|---|
| 5,899,855 | A | 5/1999 | Brown |
| 5,913,310 | A | 6/1999 | Brown |
| 5,918,603 | A | 7/1999 | Brown |
| 5,933,136 | A | 8/1999 | Brown |
| 5,940,801 | A | 8/1999 | Brown |
| 5,943,044 | A | 8/1999 | Martinelli et al. |
| 5,951,300 | A | 9/1999 | Brown |
| 5,956,501 | A | 9/1999 | Brown |
| 6,032,119 | A | 2/2000 | Brown et al. |
| 6,091,402 | A | 7/2000 | Howell |
| 6,144,837 | A | 11/2000 | Quy |
| 6,167,362 | A | 12/2000 | Brown et al. |
| 6,213,872 | B1 | 4/2001 | Harada et al. |
| 6,302,789 | B2 | 10/2001 | Harada et al. |
| 6,364,315 | B1 | 4/2002 | Velke, III |
| 6,409,636 | B1 | 6/2002 | Risso et al. |
| 6,600,477 | B1 | 7/2003 | Howell |
| 6,641,508 | B1 | 11/2003 | Ignatovich |
| 6,695,694 | B2 | 2/2004 | Ishikawa et al. |
| 6,742,909 | B2 | 6/2004 | Conti et al. |
| 6,918,769 | B2 | 7/2005 | Rink |
| 6,996,261 | B2 | 2/2006 | deCharms |
| 7,021,808 | B2 | 4/2006 | Currie et al. |
| 2004/0077423 | A1 | 4/2004 | Weston et al. |
| 2006/0025282 | A1 | 2/2006 | Redmann |
| 2006/0121428 | A1 | 6/2006 | Terrazas |
| 2006/0293041 | A1 | 12/2006 | Kim |
| 2008/0076637 | A1 | 3/2008 | Gilley et al. |
| 2008/0076972 | A1 | 3/2008 | Dorogusker et al. |
| 2008/0077489 | A1 | 3/2008 | Gilley et al. |
| 2008/0077619 | A1 | 3/2008 | Gilley et al. |
| 2008/0077620 | A1 | 3/2008 | Gilley et al. |
| 2008/0077881 | A1 | 3/2008 | Gilley et al. |
| 2008/0086318 | A1 | 4/2008 | Gilley et al. |
| 2008/0182724 | A1 | 7/2008 | Guthrie |
| 2010/0198037 | A1 | 8/2010 | Cole |

FOREIGN PATENT DOCUMENTS

| | | | | |
|---|---|---|---|---|
| WO | WO03/099389 | A1 | | 12/2003 |
| WO | WO 03099389 | A1 | * | 12/2003 |
| WO | WO2006/021952 | A2 | | 3/2006 |
| WO | WO2007/134376 | A1 | | 11/2007 |

OTHER PUBLICATIONS

Christen et al.; U.S. Appl. No. 12/390,297 entitled "A method to optimize interactive products based on their functional neural impact," filed Feb. 20, 2009.

Tranum et al.; U.S. Appl. No. 12/396,182 entitled "A physical activity-promoting game utilizing networked modules," filed Mar. 2, 2009.

Ngo et al.; U.S. Appl. No. 12/396,194 entitled "SCOOT: A physical activity-promoting game system," filed Mar. 2, 2009.

Lovett et al.; U.S. Appl. No. 12/396,206 entitled "Rhythm rope," filed Mar. 2, 2009.

Casey et al.; U.S. Appl. No. 12/396,251 entitled "U.S. Appl. No. 12/396,251," filed Mar. 2, 2009.

Stewart et al.; U.S. Appl. No. 12/396,303 entitled "Physical exercise video game method and apparatus," filed Mar. 2, 2009.

Fujiki et al.; "Neat-o-Games: Ubiquitous activity-based gaming"; proceedings of 2007 ACM Conference on Human Factors in Computing Systems (CHI), San Jose, CA; Apr. 28-May 3, 2007.

Fujiki et al.; "Neat-o-Games: Ubiquitous computing meets exertion interfaces"; proceedings of 2007 ACM Workshop on Exertion Interfaces, San Jose, CA; Apr. 29, 2007.

Buttussi et al.; "Adaptation of graphics and gameplay in fitness games by exploiting motion and physiological sensors"; A. Butz et al. (Eds. ); SG 2007, LNCS 4569; pp. 85-96; 2007.

Masuko et al.; "A fitness game reflecting heart rate"; ACE 06; Hollywood, CA, USA; Jun. 2006.

Lovett et al.; U.S. Appl. No. 13/024,215 entitled "Rhythm Rope," filed Feb. 9, 2011.

Kato et al.; A video game improves behavioral outcomes in adolescents and young adults with cancer: A randomized trial; Pediatrics; vol. 122; No. 2; pp. e305-e317; Aug. 2008.

* cited by examiner

MOOVDISK

CROSS-REFERENCE TO RELATED APPLICATIONS

This patent claims priority to U.S. Provisional Patent Application Ser. No. 61/032,903, filed on Feb. 29, 2008, titled "MoovDisk."

BACKGROUND OF THE INVENTION

Childhood obesity is on the rise both within the United States and throughout the world. This condition poses a serious problem not only for the affected children and the adults that the children will become, but for the burden on public health and the healthcare system at large. Obesity is associated with many co-morbidities, including vascular diseases such as hypertension and heart disease, chronic inflammation, glucose intolerance, insulin resistance, as well as full blown type 2 diabetes.

In addition to extensive documentation of the association between childhood obesity and poor health outcomes, a number of studies document the positive effects that physical activity has in reducing the risk of poor health outcomes associated with obesity, including reductions in the development of diabetes and heart disease. Physical activity also helps control weight, promotes psychological well-being, and reduces the risk of premature death. The Centers for Disease Control and Prevention (CDC) recommend that young people engage in at least 1 hour of moderate to vigorous physical activity each day to maintain good health.

While the positive effects of regular physical activity are well documented, motivation to maintain adequate levels of activity over the long term is often lacking. Many young people engage in sedentary behaviors (e.g., watching TV, surfing the Internet) and do not meet the CDC recommendations for physical activity. Research has found that physical activity rates decline with age among young people, with overall levels of physical activity typically beginning to decrease when children are of middle school age.

It is recognized that fun, engaging games or related products that require physical activity can be a way to increase physical activity among young people. To succeed in increasing physical activity, games need to appeal to the target population and to fit easily within the existing social, educational, and cultural environment.

Accordingly, there is a need in the commercial and healthcare product markets for smart games and related products that address and counter the growing tendency toward sedentary behaviors and that are directed toward the specific goal of increasing the overall level of physical activity of those who play the game or use the product. To succeed in this goal, products need to be easy to use, and have a quick appeal that can also be sustained over the long term. It is further desirable that such products are safe and require minimal adult supervision. Most of all, the games must be effective at their fundamental goal, which is to increase levels of physical activity.

A number of game systems have been developed. See, for example, U.S. Pat. No. 6,364,315, U.S. Pat. No. 4,072,930, U.S. Pat. No. 4,307,538, and published patent application US 2004/077423. However, none of these systems provide a versatile gaming system which allows players, and particularly children, to interact both during and after play, using remote units that communicate with a game control unit to encourage physical activity. The devices and systems described herein may address the problems described above, including some of the shortcomings of currently available game systems.

SUMMARY OF THE INVENTION

Described herein is a game system including a game control unit that wirelessly communications with a plurality of play units. The play units can have multiple states (e.g., first state, second state, etc.), and include an input (e.g., a button) that can switch between the states. The play units also include a visual indicator of the state (e.g., lights). The play units can send information to, and receive instructions from, the game control unit. The game control unit can be mobile. In some variations, the game control unit is self-propelled, and can move within a predetermined area and can deposit the play units to set up game play. The control unit may also includes a user input functionality, and can track game play and upload results (e.g., scores) into a data repository (e.g., a website, etc.). Players may wear identification tags that can transmit identifying information for tracking or monitoring by the game control unit. Also described herein is a social networking website which might be used by players of the game system.

For example, a game system may include: a plurality of play units, wherein each play unit includes a user input configured to toggle the play unit between a first state and a second state and a visual output configured to indicate the state of the game unit; a mobile game control unit configured to store and release the play units onto a playing field, wherein the mobile unit is configured to wirelessly receive status information from each of the play units, and at least one identification tag to be worn by a player and configured to wirelessly transmit identifying information.

A play unit may have two or more states that it can switch between. For example, a play unit can be in a "red" state, and illuminate a red light on the play unit to indicate this state. Activating the user input can switch the play unit into a different state, such as a "blue" state, which changes the color of the illumination to blue. More than two such states may be possible. It is preferable that the states are different from the inactive condition; thus one of the states is not simply the "off" state.

The game system may also include a boundary indicator to electronically indicate a boundary for the mobile game control unit. The boundary indicator may be an electronic fence that indicates the boundary.

The system may also include a display output that is functionally connected to the mobile game control unit to display game information. The mobile game system may have a spherical body, and may include wheels. The mobile game control unit may also include a mobility game control for controlling the movement of the mobile game control unit.

In some variations, the system also includes a player input for selecting game play options. For example, the player input may be positioned on the game control unit. The game control unit may also include one or more processors for processing status information from each of the remotely located play units. The game control unit may also include a memory for storing game status information, instructions, or the like. The game control unit may also include a computer interface, or otherwise be configured for uploading information to an external website. For example, the game control unit may include USB or wireless connections to connect to a server, or may have internal wireless communication capability for connecting to an internet server.

The play units may be configured as disks, spheres, cubes, or any other structure. The visual status indicator for each play unit may be a light source, including a light source that is configured to display colored light. For example, the light source may be an LED (or multiple LEDs). Thus, the play unit may indicate a change of state from a first color (e.g., green) to a second color (e.g., blue). As mentioned, the state change may be triggered by a user input on the play unit. For example, the user input may be a button, switch, dial, etc.

The identification tag may be any appropriate identification tag, particularly those that wirelessly communicate with the play units and/or game control unit. For example, an identification tag may be an RFID transmitter that is configured to be detected by the play units.

Also described herein are methods of playing a game using the system or devices described above. For example, a method of playing a game may include the steps of: distributing a plurality of individual play units in a game-play area, wherein each play unit includes an input for toggling the play unit from a first state to a second state and a visual output indicating the state of the play unit; visually indicating the state of a play unit by activating the visual output on that play unit; activating the input of a play unit to change the state of the play unit; and transmitting status information including the change of state from the game unit to a remotely-located game control unit.

In some variations, the method also includes the step of identifying the player at the play unit when the player changes the state of the play unit. For example, a player may be attempting to switch all of the play units from a first state (e.g., visually apparent as a green light on top of the play unit) to a second state (e.g., shown by a blue light on the play unit). The play unit may store and/or transmit the player identity as well as the fact (and/or time) that it was changed from the first state to the second state. The game control unit may receive this information for keeping score, determining a winner, analyzing game play, and/or uploading or otherwise storing the game information. In another variation, the game control will also have a timer unit which will indicate a winner after a certain period of time has elapsed. For example, the game control will count the number of disks for each color and identify the winner as the individual or team with the predominate number of that individual or team's play units.

Game play may also include a step of distributing the individual play units automatically by the game control unit. For example, the game control unit may be mobile. In some variations, the game control unit randomly distributes the play units. In other variations, the game control unit arranges the play units in a predetermined pattern.

The method of play may also determine the initial state of the play units. For example, the play units may be initially set so that about half of the play units are in a first state and the rest of the play units are in a second state. The method of play may also include a step of indicating that the game is over when all of the play units are in the same state. For example, the game control unit may indicate that the game is over.

Information about the status of game play may be uploaded (e.g., to a website, a social networking site, etc.). For example, the game control unit may upload game information (including the player-identifying information, scores, statistics on game play, and the like).

The game control unit may also be used to select which game will be played. Examples of games include capture-the-flag type games, as well as tag games, obstacle course games, hide-and-seek type games, etc.

INCORPORATION BY REFERENCE

All publications and patent applications mentioned in this specification are herein incorporated by reference in their entirety to the same extent as if each individual publication or patent application was specifically and individually indicated to be incorporated by reference.

DETAILED DESCRIPTION OF THE INVENTION

Described herein are game devices and game systems including a master control unit and a plurality of play units that wirelessly communicate with the control unit. In general, the play units include one or more user inputs that allows the user to switch a visual state parameter for the individual play unit from a first state, in which the play unit visually indicates that it is in the first state, to a second state, in which the play unit visually indicates that it is in the second state. The play unit may send game information to the control unit, which can monitor the game play (e.g., scoring, determining a winner, etc.). One or more players may play with the game system, and each player may be given an identifying tag, which can be read by the play units and/or the master game control unit. The identifying tag allows the system to track which player is has activated a particular play unit.

Before the start of the game, the play units are distributed around the playing area (e.g., a field, a room, multiple rooms, etc.) and are set to an initial state. Depending on the game chosen for play, players may then move around the playing area and cause individual play units to change to a desired state by activating the user input on the play unit. The play units display (e.g., by color change, light change, pattern change, etc.) their current state. A play unit may also send information about a change in state to the game control unit. For example, the play unit may indicate to the game control unit that at time T, player Z changed its state to Y.

Figure 1:
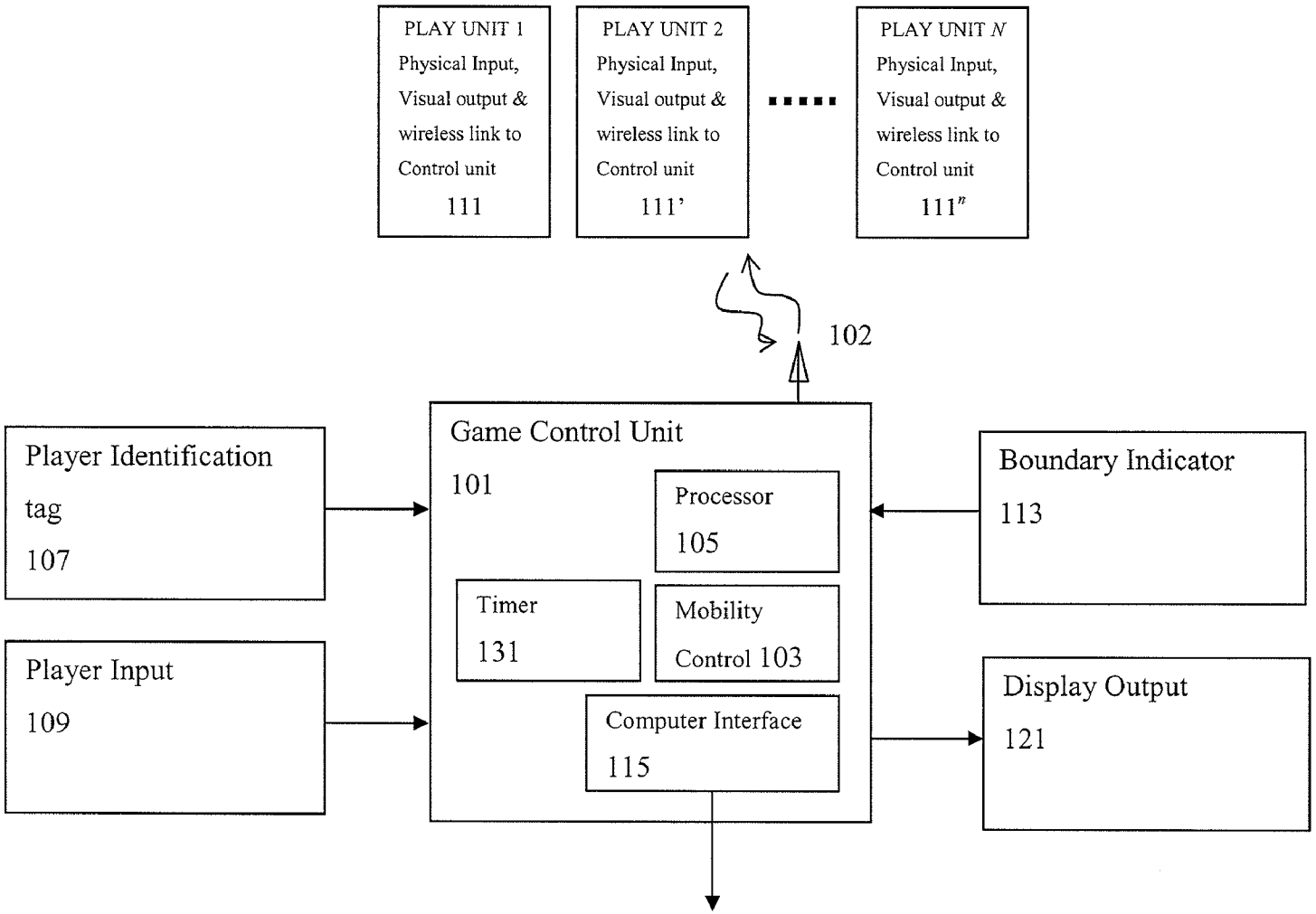
FIG. 1 is schematic illustrating one variation of a game system.

FIG. 1 illustrates one variation of a game system including these features, as well as additional and optional features. In FIG. 1, the game control unit 101 includes a wireless receiver/transmitter and may also include a processor 105 for processing game data and other inputs, and providing output (e.g., to the play units 111, 111', etc., to a display 121, or the like). The game control unit may be referred to as the "MoovDisk" or the master unit. The game control unit may also include a display 121, or may interface with a computer, server or network.

Figure 2:
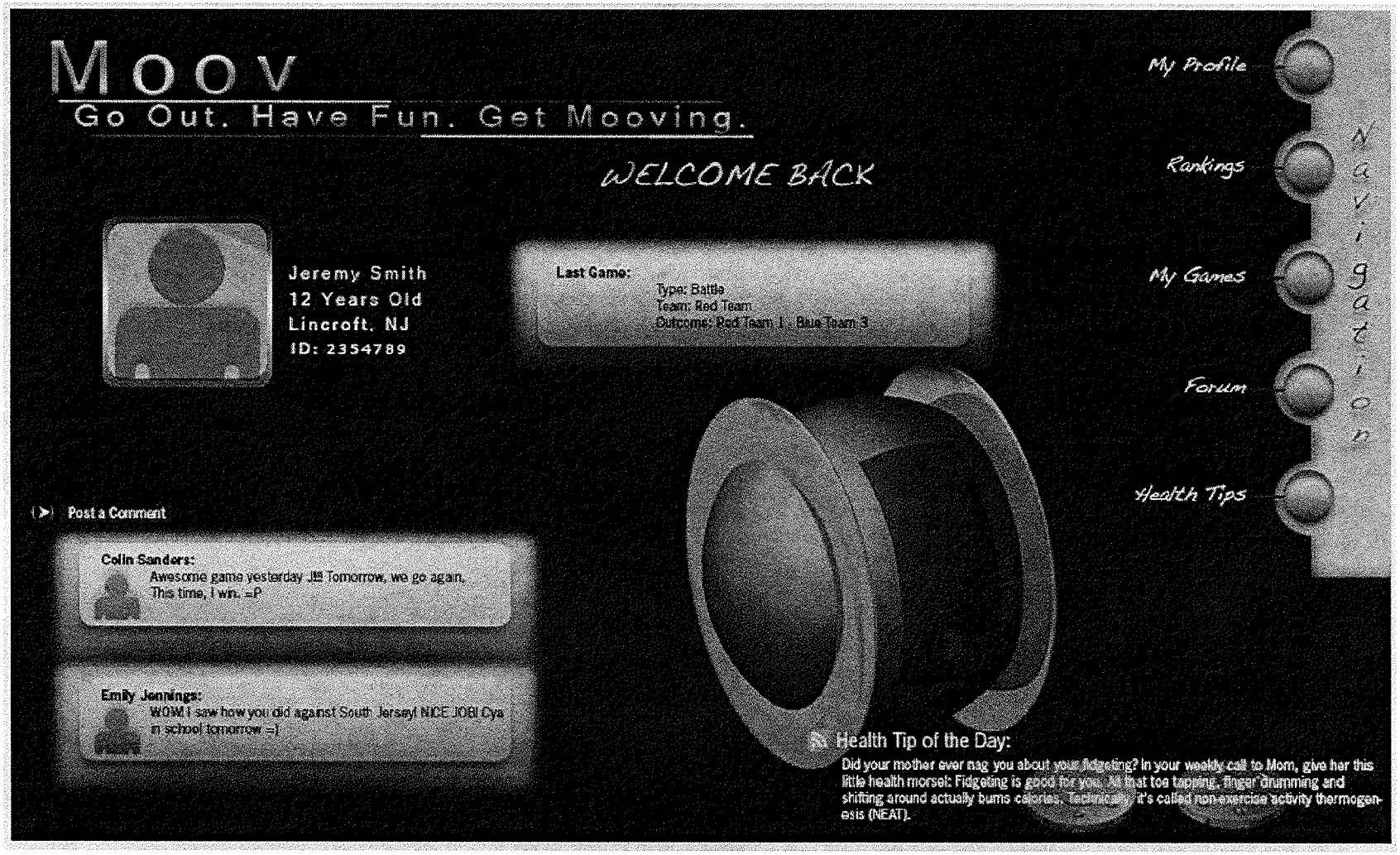
FIG. 2 is a simulated screenshot from a social networking website/game website that may be used with the game system described.

The game control unit may have a housing that is esthetically or functionally shaped. For example, the control unit may have a housing that is spherically shaped, and include a compartment for holding, storing or delivering the play units 111, 111' . . . 111". In some variations, the housing is rounded, columnar or spherical. For example FIG. 2 illustrates one variation of the game control unit 200 that is spherical. This unit includes a storage compartment for holding play units.

The game control unit may also be mobile, allowing the game control unit to be moved at least partially over the playing field. For example, the game control unit may include wheels. In some variations, the game control unit is mobile and is self-propelled. Thus, the game control unit can automatically move across the playing field to deposit play units in the playing field. In variations in which the game control unit 101 is self-propelled, it may be kept within the boundary of the playing field by one or more boundary indicators 113.

The boundary indicator may create an electronic barrier (e.g., by RFID transmission) that prevents the game control unit from leaving the playing field. In this example, the self-propelled game control unit may include a mobility control 103 that includes a guidance system and controls the movement of the game control system as it moves across the field and distributes the play units.

In some variations, the game control unit is not self-propelled, and a user may manually distribute the play units in the playing area.

Each play unit 111, 111' . . . 111" typically includes a user input that is configured to change the 'state' of the play unit, a visual output that indicates the current state of the device, and a wireless transmitter for sending game status information to the game control unit 101. A play unit may also be referred to as a disk or drone unit. For example, the play unit may be a disk that includes one or more lights on the top of the disk. The light can indicate the status of the play unit. In some cases the visual output (e.g., light) is a color LED, and the color illuminated indicates the status. In other variations, the status is indicated by other visual outputs, such as the number of lights illuminated, raising a flag, etc. Any appropriate number of play units may be used.

Play unit may also include a receiver/transceiver for receiving identification information from a nearby player. For example, the play unit may include an RFID reader that is configured to read the RFID identification tag 107 worn or held by a user. When the user activates the input on the play unit 111 to change its state, the play unit may determine the identity of the user and transmit this, as well as additional status information (e.g., time of activation, current state, etc.). This allows the system to track when a particular user changes the state of the play unit.

The game system may be used to play a wide variety of games involving the play units, or may be used for free-form play. For example, the game system may be used to play capture-the-flag type games, in which teams of players attempt to convert all of the play units to one state or the other. Each team can have a different associated state. In one variation, the play units include a pair of colored lights (e.g., blue and red) as the visual output. The first team attempts to convert all of the play units to the first color (blue) and the second team attempts to convert them all to the second color (red). The game control unit can regulate play, e.g., by tracking play and by instructing the game units based on the format of game play. For example, depending on the game, the game control unit may set the initial state of the play units, a delay time before individual game units can be activated between state changes, etc. In another variation, a timer 131 can be used to identify the winning team after a certain elapsed period as the team with the predominate number of colored lights.

Other games could include tag type games (in which players attempt to find and tag one or more play units in a certain state) and "follow-the-leader" type games (in which players sequentially run to individual play units as they are illuminated by the game control unit). Other types of games are also contemplated. The game control unit may also include a player input (e.g., keyboard, buttons, touch screen, etc.) that allows the user to select which game they would like to play, or to enter the number of players, the duration of the game, or other pertinent information.

The game system may also be used with a social networking or other website or communications component. FIG. 2 illustrates an exemplary page of a website in which the player can interact with other players, keep track of their scores and games played, and post and compare their scores in various games. The website may also provide useful information designed to educate the player.

Described below is one exemplary variation of the game devices and systems described herein.

EXAMPLE

The control unit of the game system may be referred to as a "MoovDisk", and in one example is a spherical device about 18 inches in diameter. As seen in FIG. 2, the sphere 200 has two large wheels and an electronic screen. The wheels may allow the sphere to roam around freely on both grass and blacktop surfaces, which allows the game (which may also be referred to as "MoovDisk") to be played in multiple locations. The playing field can be determined by 4 infrared "wall" units that can be included with the MoovDisk "Starter Pack". These small units act as invisible walls; the sphere is unable to cross the path of the small bases. The "Starter Pack" also includes two red wristbands and two blue wristbands. Players must use these wristbands to separate themselves into teams. Additionally, each wristband has a unique ID number that can be used to create personal profiles on the MoovDisk website, as well as to scan into the sphere prior to games (this is how scores are recorded). Extra wristbands will be sold separately to allow increases in the number of players per team.

Although it is not evident in the picture, there is a slot in the bottom of the sphere that releases the blue and red disks. After the disks, which each have either red or blue LED lights and an external button, are released by the sphere, the game begins. There are three MoovDisk game modes: 1 single-player and 2 multi-player modes. In the single-game mode, the sphere releases all 20 disks in various locations in the playing field. As soon as the last disk is placed on the ground, the internal timer in the sphere will start. The player will run around and try to press the buttons on each disk as quickly as possible. When the button is pressed, the light is turned off and the disk has officially been "tagged". The total time it takes for the player to complete the challenge will then be recorded in the internal memory of the sphere. In the first multi-player game (Speed Mode), each team of kids will race to find their colored disks (half will be red and half will be blue) and press the buttons on each disk before the other team. Battle Mode, the version that offers most intensive exercise, offers a slight twist on Speed Mode. Even though the disks will still originally be half red and half blue, the goal of the game is to make every single disk the same color. For example, every player with a red wristband will try to press the button on blue-colored disks; this will change the color of the disk to red until a member of the blue team presses it again. Depending on personal ability and team size, this particular mode can turn into a rather intensive workout ranging from 15-25 minutes in duration.

The digital component of the product works off of these game results. After the player has made a personal profile on the website, he can plug the sphere into a computer using the included USB port. Then, all of the accumulated game results, which are transferred to the sphere memory through RFID communication between the disks and the sphere, will be uploaded to the website. The modem, appealing design of the website (also seen on the attached sheet) will be attractive to the 11-14 year old children. Friends will be able to discuss game results via comments on each other's pages, and there will be a variety of leader boards that acknowledge the finest MoovDiskers. Moreover, players will be able to review their personal single-player time trials to see how they have personally improved in speed and coordination from playing this game.

When explaining MoovDisk to potential players, the majority of the technical description above will not be necessary. Instead, the enjoyment aspect of the game will be stressed. For example, the game can be considered a high-tech combination of Capture the Flag and Laser Tag that can be played at home. The social possibilities of this game would also be described; children of this age would enjoy forming teams among friends and competing to see who is the best at this game. Finally, with the popularity of current social networking sites like Myspace and Facebook, both children and parents would appreciate this child-friendly website that encourages both exercise through MoovDisk and a healthy lifestyle in general.

While the systems, devices and methods for using them have been described in some detail here by way of illustration and example, such illustration and example is for purposes of clarity of understanding only. It will be readily apparent to those of ordinary skill in the art in light of the teachings herein that certain changes and modifications may be made thereto without departing from the spirit and scope of the invention.

What is claimed is:

1. A game system comprising:

a plurality of play units, wherein each play unit includes a user input functionality configured to toggle the play unit between a first state and a second state and a visual output configured to indicate the state of the game unit;

a mobile game control unit configured to store and release the play units onto a playing field, wherein the mobile unit is configured to wirelessly receive status information from each of the play units; and at least one identification tag to be worn by a player and configured to wirelessly transmit identifying information.

2. The system of claim 1, further comprising at least one boundary indicator to electronically indicate a boundary for the mobile game control unit.

3. The system of claim 1, further comprising a display output functionally connected to the mobile game control unit to display game information.

4. The system of claim 1, further comprising wheels connected to the mobile game control unit.

5. The system of claim 1, further comprising a player input on the mobile game control unit for selecting game play options.

6. The system of claim 1, wherein the mobile game control unit includes a mobility game control unit for controlling the movement of the mobile game control unit.

7. The system of claim 1, wherein the mobile game control unit includes a processor for processing status information from each of the play units.

8. The system of claim 1, wherein the play units are disks.

9. The system of claim 1, wherein the visual status indicator for each play unit is a light source configured to display colored light.

10. The system of claim 1, wherein the user input of the visual status indicator is a button.

11. The system of claim 1, wherein the identification tag comprises an RFID transmitter configured to be detected by the play units.

12. The system of claim 1, wherein the mobile game control unit comprising a computer interface.

* * * * *